US007179165B2

(12) United States Patent
Cook

(10) Patent No.: US 7,179,165 B2
(45) Date of Patent: Feb. 20, 2007

(54) AUTOMATIC VENT DAMPER

(76) Inventor: William V. Cook, 2677 Wyndsor Oaks Pl., Winter Haven, FL (US) 33884

( * ) Notice: Subject to any disclaimer, the term of this patent is extended or adjusted under 35 U.S.C. 154(b) by 73 days.

(21) Appl. No.: 11/032,174

(22) Filed: Jan. 11, 2005

(65) Prior Publication Data

US 2006/0172696 A1 Aug. 3, 2006

(51) Int. Cl.
*F24F 7/02* (2006.01)
*E04B 7/00* (2006.01)

(52) U.S. Cl. ..... 454/360; 454/362; 454/363; 454/364; 52/198

(58) Field of Classification Search ..... 454/335–336, 454/348, 355, 356, 358, 360–365; 52/198
See application file for complete search history.

(56) References Cited

U.S. PATENT DOCUMENTS 3,323,438 A * 6/1967 Korff ..... 454/357
3,392,658 A * 7/1968 Korff ..... 454/362
4,848,653 A 7/1989 Van Becelaere
4,962,692 A 10/1990 Shuert
5,052,286 A 10/1991 Tubbesing et al.
5,112,278 A * 5/1992 Roberts ..... 454/365
5,147,244 A 9/1992 Spilde
5,158,502 A 10/1992 Frost
5,826,383 A 10/1998 Garrison
6,202,372 B1 3/2001 Powell
6,500,061 B1 12/2002 Ambrose
6,558,251 B2 5/2003 Sells
6,733,381 B1 5/2004 Plueger
2001/0019941 A1 9/2001 Headrick
2002/0187744 A1 12/2002 Cedergreen et al.
2002/0187745 A1 12/2002 Smith
2003/0077999 A1 4/2003 Mankowski (Continued)

FOREIGN PATENT DOCUMENTS

DE 3103332 8/1982

(Continued)

OTHER PUBLICATIONS doityourself.com/attic/ridgevents.htm, website, printed Nov. 26, 2004, Cor-A-Vent® and Celotex Roll Vent® continuous ridge vent material, three sheets.

(Continued)

*Primary Examiner*—Josiah Cocks
*Assistant Examiner*—Helena Kosanovic
(74) *Attorney, Agent, or Firm*—Richard C. Litman

(57) ABSTRACT

The automatic vent damper has various embodiments of a wind actuated vent system, which automatically closes to preclude entry of wind blown water when a wind of predetermined velocity and direction acts upon the device. The damper may be installed as an off-ridge or ridge vent system, or in other operating environments and installations as desired. Various mechanisms are used to operate the device, with all including one or more springs, which hold a rigid door or flap, open in light wind conditions. However, when a wind of sufficient velocity blows toward the vent opening, the door or flap is closed due to aerodynamic forces thereon to preclude entry of wind blown water into the device. The door or flap automatically opens again due to the spring mechanism when the wind abates.

14 Claims, 4 Drawing Sheets

U.S. PATENT DOCUMENTS

| | | | |
|---|---|---|---|
| 2004/0000101 | A1 | 1/2004 | Dixon |
| 2004/0128920 | A1 | 7/2004 | Sharp et al. |
| 2004/0132401 | A1 | 7/2004 | Rotter |
| 2004/0198216 | A1 | 10/2004 | Morris et al. |

FOREIGN PATENT DOCUMENTS

| | | |
|---|---|---|
| JP | 59-202344 | 11/1984 |
| JP | 2003-041726 | 2/2003 |
| JP | 2003-176597 | 6/2003 |

OTHER PUBLICATIONS kbsmetalroofing.com/x5.htm website, printed Nov. 26, 2004, "X-Treme X-5" ridge vent, two sheets.

* cited by examiner

AUTOMATIC VENT DAMPER

BACKGROUND OF THE INVENTION

1. Field of the Invention

The present invention relates generally to roof vents and other vent systems for building structures. More specifically, the automatic vent damper relates to an aerodynamic device that is urged open by one or more springs, but which is blown closed by aerodynamic pressure when the wind blows inwardly toward the vent.

2. Description of the Related Art

Vent systems are important components of building structures and serve to reduce heat and humidity, which would otherwise build up in a structure. Vents are nearly universally installed in the attic areas of homes and similar structures, either as end gable vents, ridge vents, or off-ridge vents, but are also installed as smaller installations to vent moist, warm air from clothes dryers and for similar purposes.

Such vents are generally stationary structures, with no moving parts or components. Generally they are screened to preclude the entrance of small animals and insects into the structure by way of the vent, but little or no additional closure is provided. It is essential that the vent remain open during the vast majority of its use; closure would defeat the purpose of the vent, i.e., to allow warm and/or humid air to escape from the structure in order to reduce temperatures during the day and structure damaging condensation when the structure cools.

However, vents that remain open at all times may not be desirable. Under certain circumstances, e.g., high winds and rain, water can be driven past any internal baffling within the vent, and on into the attic or upper portion of the structure. This same effect can occur with smaller appliance vents as well. Yet, very little has been done to this point to provide systems for the closure of vents when so required.

The present inventor is aware of a few such devices, which operate using different principles than those employed by the present automatic vent damper. An example of such a different device is shown in German Patent Publication No. 3,103,332, published on Aug. 12, 1982, which describes (according to the drawings and English abstract) a preformed plastic structure having a series of covered vent openings therein. The device is configured as a ridge vent and cannot be readily adapted for other locations. No moving components or automated closure is provided.

Japanese Patent Publication No. 59-202,344, published on Nov. 16, 1984, describes (according to the drawings and English abstract) a ridge line vent system having a series of relatively small, circular vents which open and close automatically by means of a thermostatic spring element. No means is provided to close off the vent system in the event of high winds.

Japanese Patent Publication No. 2003-041,726, published on Feb. 13, 2003, describes (according to the drawings and English abstract) a series of embodiments of a ridge vent assembly having a series of stationary baffles therein to reduce the entry of blown in water therein. No moving parts or closure, either automated or manual, is provided.

Finally, Japanese Patent Publication No. 2003-176,597 published on Jun. 24, 2003 describes (according to the drawings and English abstract) a soffit vent having an expandable material therein which expands when exposed to extreme heat (e.g., a structural fire) to close off the vent passages. No reversal of the actuation is provided, and no actuation due to wind or other airflow is provided.

None of the above inventions and patents, taken either singly or in combination, is seen to describe the instant invention as claimed. Thus, an automatic vent damper solving the aforementioned problems is desired.

SUMMARY OF THE INVENTION

The automatic vent damper comprises various embodiments of a device having an aerodynamically actuated rigid flap or door which is blown closed in high wind conditions to block entry of wind-blown water into and through the vent. The rigid door or flap is normally held open by one or more light springs, but blows closed when a predetermined wind velocity acts upon the device in a direction to blow inwardly into the vent. Various embodiments are provided, including off-ridge and ridge vents, with the embodiments being adaptable to other installations and environments as well. Different closure mechanisms are also provided.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an automatic vent damper, in which a vent door is held open by a spring mechanism and is drawn closed by aerodynamic forces when sufficient wind arises to generate an aerodynamic closure force on the vent door. The present automatic damper thus prevents wind-driven rain, spray, or other moisture from blowing past the baffles within the vent housing and damaging the interior of the structure. When the wind abates, the spring mechanism swings the vent door open again for normal vent operation.

Figure 1:
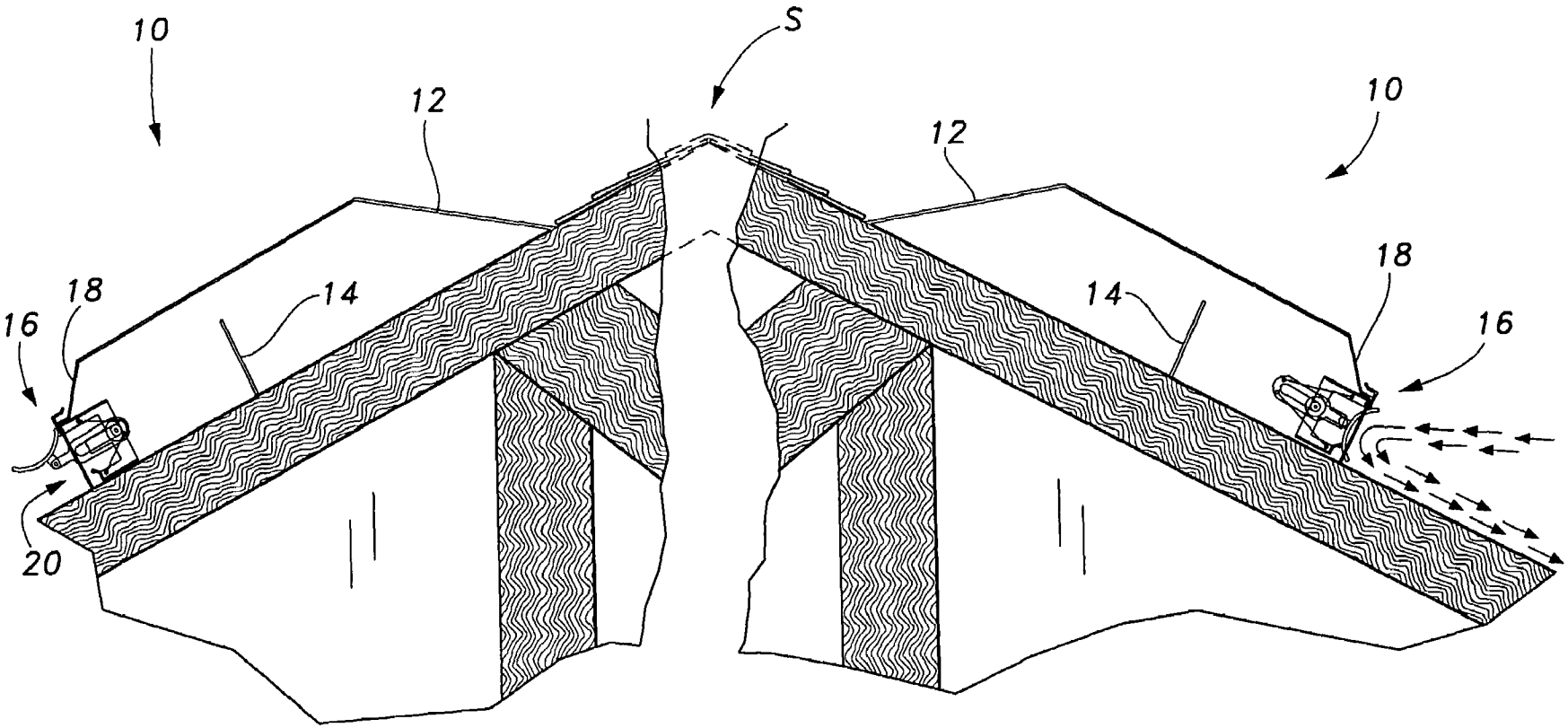
FIG. 1 is a schematic elevation view in section of a roof incorporating a pair of off-ridge automatic vent dampers according to the present invention, and showing their operation.
Figure 2:
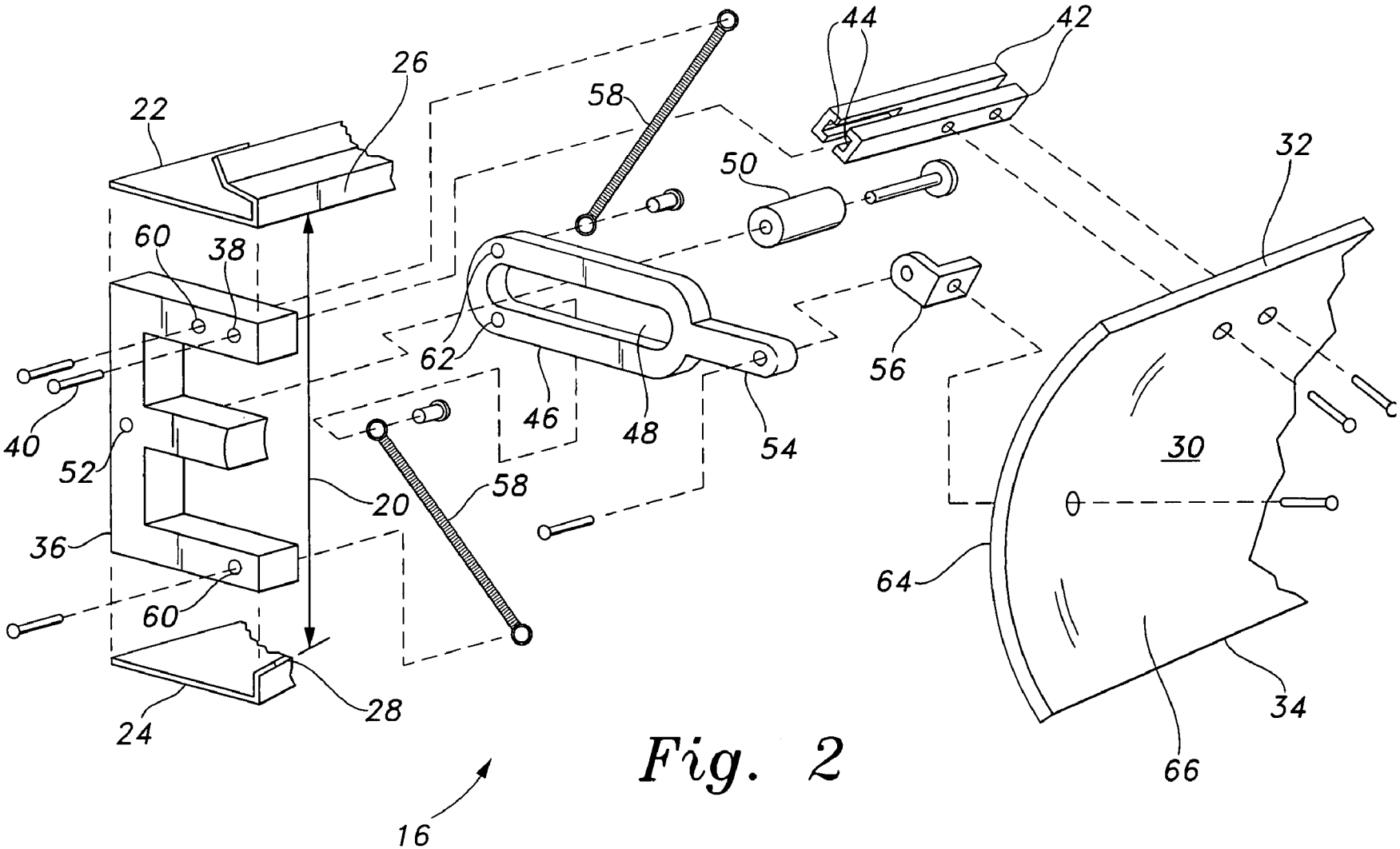
FIG. 2 is an exploded perspective view of the actuating mechanism of the automatic vent damper embodiment of FIG. 1, showing various details thereof.

FIGS. 1 and 2 illustrate a first embodiment of the present damper and its mechanism, with FIG. 1 showing a pair of independent units installed within two off-ridge vents 10, which, in turn, are installed to opposite sides of the ridge crest of the structure S. The two units 10 are essentially identical to one another, but are turned to face down the slopes of the roof on the opposite sides of the ridge crest. Each vent 10 includes a housing 12, which may be formed conventionally of one or more panels of sheet metal or other suitable material. A baffle 14 is placed within the housing 12, to reduce the amount of wind-blown water entering the upper portion of the vent 10 and the structure S. Such baffles 14 are not completely effective, as noted further above. The present automated damper 16, located in the single opening 20 in the lower side 18 of the vent housing 12, provides positive closure of the housing 12 when sufficient wind velocity blows substantially toward the vent door opening 20.

FIG. 2 provides a detailed exploded perspective view of one of the automated vent damper assemblies 16, e.g., the right hand unit with the vent door opening 20, the extent of which is indicated by the double arrow in FIG. 2, facing to the right. The vent door opening 20 is defined by the forward or lower edge portion of the upper panel 22 and the forward or lower edge portion of the lower panel 24 of the housing 12, with the two forward or lower edges of the panels 22 and 24 respectively comprising the opposite upper and lower edges 26 and 28 of the vent door opening 20. A rigid, aerodynamic vent door 30 has an upper edge 32 pivotally attached to the upper edge 26 of the upper panel 22 and an opposite lower edge 34, which contacts the lower edge 28 of the vent door opening 20 when the vent door 30 is blown closed. Conventional weather stripping or seals (not shown) may be installed along the vent door edges as desired or required.

The automated damper embodiment 16 of FIGS. 1 and 2 is based upon a frame structure, comprising opposite first and second members 36 at opposite ends of the door opening 20 (only one member 36 is shown in FIGS. 1 and 2, due to the end elevation view of FIG. 1 and the partial section view of FIG. 2). The housing 12 components, e.g., the upper and lower panels 22 and 24, are secured (e.g., riveted, bonded, etc.) to the frame members 36 to form a closed housing 12, with the exception of the single vent door opening 20 and conventional passages (not shown) into the structure S to which the vent assemblies 10 are installed.

Each of the frame members 36 includes an upper vent door pivot hole 38, with a pivot pin 40 (rivet, bolt, pin, etc.) installed therein. The vent door attachment comprises a pair of identical blocks 42, each having a pivot pin channel 44 formed therein. The two blocks 42 are assembled in mirror image to one another with their two channels 44 facing one another to form a closed pivot pin passage, and are secured (e.g., riveted) to the vent door 30 adjacent its upper edge 32.

A vent door yoke 46 urges the vent door 30 toward its normally open position when insufficient wind force exists to close the door 30, as shown in the left side vent assembly 10 in FIG. 1. The yoke 46 includes an elongated vent door roller slot 48 formed therethrough, with the yoke 46 riding on a vent door roller 50 which slides within the slot 48 and which is, in turn, rotationally affixed to the frame member 36 at a generally medial roller attachment point 52. The yoke 46 includes a distal vent door attachment arm 54 extending therefrom, which attaches pivotally to a yoke attachment lug 56 secured to the vent door 30 at about its mid-span. A similar attachment lug could be used as the vent door pivot in lieu of the vent door attachment blocks 42, if so desired, or alternatively such blocks 42 could be used in place of the yoke attachment lug 56, if so desired.

The yoke 46 is urged to an extended position, i.e., with its vent door attachment arm 54 extending outwardly through the vent door opening 20 of the housing 12, by at least one (and preferably one or more pairs, for symmetry) door yoke tension spring 58. The spring(s) 58 extends between respective door yoke spring attachment points 60 on the upper and lower portions of the frame 36, and corresponding door yoke spring attachment points 62 on the door yoke 46. The spring(s) 58 applies a tensile force to the yoke 46 relative to the frame member 36, urging the yoke 46 outwardly relative to the vent housing opening 20, thus pivoting the vent door 30 open by means of the mechanism described further above, generally as shown in the left side vent assembly 10 of FIG. 1.

The rigid vent door 30 will be seen to have a curvature or camber, particularly visible in the detailed drawing of FIG. 2. The curvature provides a positive or convex camber to the downwardly oriented surface 64 when the door 30 is open, i.e., the left, inwardly facing surface 64 in FIG. 2. The opposite side or surface 66 has a corresponding negative or concave camber. The positive, convex cambered surface 64 results in a relatively lower aerodynamic pressure over this surface in comparison to the opposite surface 66 when the wind blows over or across the door 30, as when the door 30 is open and the wind direction is such that airflow is entering the vent housing 12 through the vent opening 20 therein.

When the wind reaches a predetermined velocity, the aerodynamic force generated on the vent door 30 drives the vent door 30, and hence the yoke 46, backward to a closed position, applying tension to the ends of the spring(s) 58 and extending the spring(s) 58. The required wind velocity is dependent primarily upon the spring constant of the spring. Once the vent door has been drawn closed, the wind pressure is applied to the concave surface 66 of the door 30, thus tending to hold the door 30 closed, generally as shown in the right side vent assembly 10 in FIG. 1. Thus, the closed vent door 30 precludes the entrance of windblown rain, spray, and/or other moisture and/or foreign matter into the vent housing 12, thereby keeping such matter out of the interior of the structure S to keep the structure dry. It will be seen that the present automatic vent damper also serves to keep out wind-blown dust and other debris that may be picked up in high winds, thus keeping the vent and underlying structure cleaner as well. When the wind abates, the closure force on the vent door 30 is lessened, the compressive force of the spring(s) 58 eventually overcoming the relatively weaker aerodynamic pressure of the lower wind velocity to return spring(s) 58 to its rest position and draw yoke 46 forward. This allows the vent door 30 to swing open again on pivot pin 40 in order to allow the vent 10 to function normally.

Figure 3:
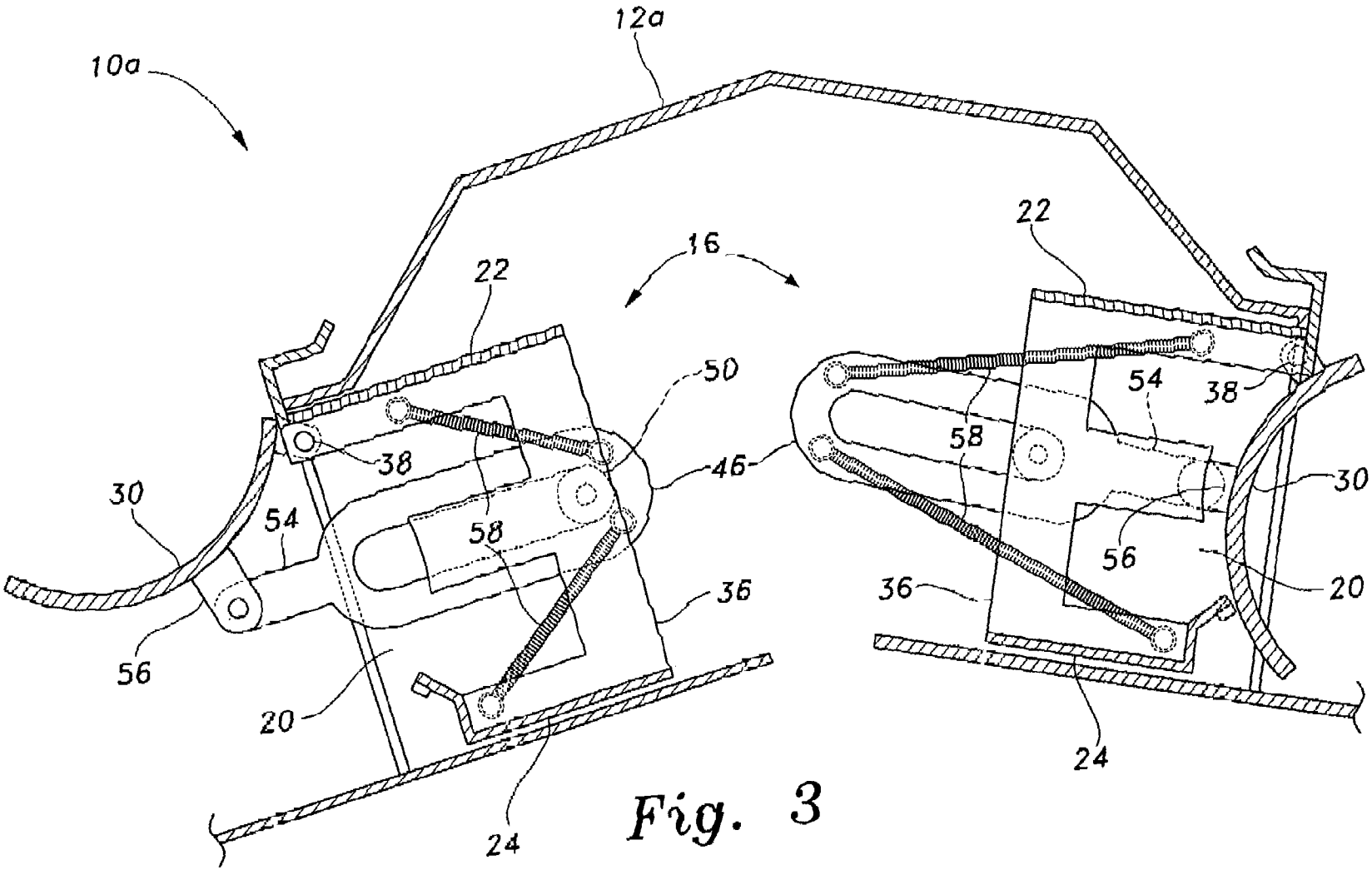
FIG. 3 is a detailed schematic elevation view of an alternate embodiment of the automatic mechanism of FIGS. 1 and 2, incorporated in a ridge vent.

FIG. 3 of the drawings provides a detailed side elevation view in section of a slightly different embodiment of the present automatic vent damper, in which two such damper mechanisms 16 are installed in opposition to one another in the two opposed openings 20 of the single laterally symmetrical ridge crest or roof peak vent housing 12*a* of a ridge vent assembly 10*a*. The actuation mechanisms of the vent assembly 10*a* are identical with those of the off-ridge vent assemblies 16 of FIGS. 1 and 2, and include housing panels or elements 22 and 24 containing frame members 36, yokes 46 and their rollers 50, and tension springs 58.

The same vent door 30 configuration as shown in FIGS. 1 and 2 is used in the embodiment of FIG. 3, with the door 30 being pivotally secured to the upper vent door pivot 38 in the frame 46 and actuated by the vent door yoke arm 54 and its attachment to the vent door attachment lug or bracket 56. The left side vent assembly 16 is shown in its normally open position, i.e., with the tension springs 58 urging the yoke 46 to its outwardly extended position to hold the vent door 30 open in light wind conditions, or when the wind is blowing from some direction other than into the vent opening 20. The opposite right side vent assembly 16 is shown with its vent door 30 blown closed, as would occur in conditions of higher wind velocities blowing more or less into the vent opening 20.

Figure 4:
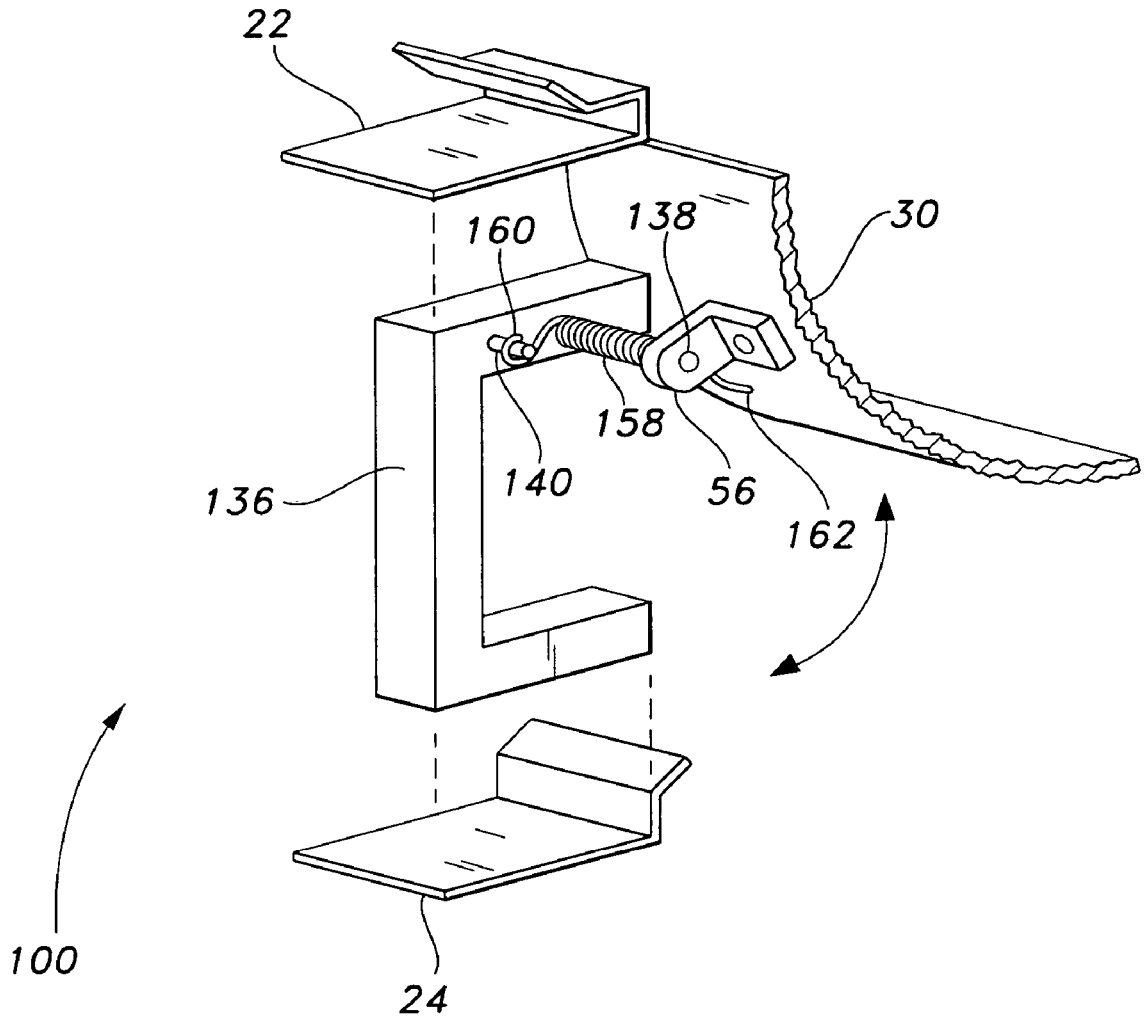
FIG. 4 is an exploded perspective view of another alternative embodiment incorporating a different actuating mechanism from the embodiments of FIGS. 1 through 3.

FIG. 4 is a partially broken away exploded perspective view of yet another embodiment 100 of the present damper, in which a different biasing spring arrangement is used. The embodiment 100 of FIG. 4 includes upper and lower housing panels 22 and 24, which combine to contain a first frame member 136 therein. At least a second frame member, not shown, is used to support the unshown opposite end of the assembly. The frame member 136 has an elongated, laterally extending vent door pivot pin 138 forming a hinge or pivot axis for the vent door 30. The vent door 30 is pivotally secured to the pivot pin 138, and thus to the frame member 136, by a door attachment arm 56, substantially similar to the lug or attachment arm 56 of FIGS. 2 and 3 used to secure the door 30 pivotally to the yoke 46 in that embodiment.

A helical vent door torsion spring 158 is secured concentrically about the vent door pivot pin 138, and urges the vent door 30 to a normally open position. The spring 158 has a first or frame member attachment end 160 which is secured to the vent door spring attachment point 140 of the frame member 136, and an opposite second or vent door biasing end 162 which bears against the inner or convex surface 64 of the vent door 30. The spring 158 is wound or coiled to apply a torsion thereto, with the captured frame attachment end 160 of the spring 158 being held in position on the frame 136 and the opposite second or vent door biasing end 162 applying a torsional force to the vent door 30 to hold the door 30 open in relatively light wind conditions. However, when the wind blows with sufficient strength and direction to draw the vent door closed, as described further above for the embodiments of FIGS. 1 through 3, the torsional resistance of the spring 158 is overcome and the door 30 is blown closed to seal the vent assembly 100 (and thus the interior of the structure to which it is attached) from the elements. The spring 158 opens the vent door 30 once again, when the wind direction or velocity changes so as to reduce the closure forces on the door 30 to allow the spring 158 to overcome those forces and reopen the door 30.

In conclusion, the present automatic vent damper in its various embodiments provides a much needed means of automatically closing out windblown moisture and other foreign particles (dust, etc.), which would otherwise enter a structure through the vent system. The present automated damper, with its rigid, aerodynamic damper door, provides a very simple and economical means of automatically preventing the entry of moisture, dust, and similar material, utilizing only aerodynamic forces to close the damper door and opposing spring forces to bias the door in an open position when the wind has abated. While the present automated damper is directed principally to use in off-ridge and ridge vents in building construction, it will be seen that shorter and/or smaller embodiments may be applied as end gable vents, clothes dryer vents, and similar installations, as desired. The present automated vent damper is particularly well suited for use in environments where high winds and rain occur, as in hurricane country, but will find widespread application in most areas of the country, wherever wind and rain may combine forces to blow water or moisture into the interior of a building structure.

It is to be understood that the present invention is not limited to the embodiments described above, but encompasses any and all embodiments within the scope of the following claims.

I claim:

1. An automatic vent damper, comprising:

a housing having at least one vent door opening defined therein, the opening having at least an upper edge and a lower edge opposite the upper edge;

at least one rigid, aerodynamic vent door having at least an upper edge and a lower edge opposite the upper edge, the door being pivotally disposed over the at least one vent door opening, wherein:

said at least one aerodynamic vent door has a downwardly facing positive camber when in an open position, whereby wind flow entering the at least one vent door generates an aerodynamic force drawing said at least one vent door automatically closed; and said at least one aerodynamic vent door further has an outwardly facing concave face when in a closed position, whereby wind flow contacting the concave face holds said at least one vent door automatically in a closed position, the outwardly facing concave face having a concave contour extending over the entire outwardly facing concave face;

a vent door attachment disposed at the upper edge of the at least one vent door opening, pivotally securing the upper edge of said vent door to said housing; and at least one spring connected between said at least one vent door and said housing, automatically biasing said at least one vent door open in wind conditions less than a predetermined velocity and direction relative to the vent door opening and the spring constant of said at least one spring and automatically allowing said at least one vent door to blow to a closed position when the wind reaches a predetermined velocity and direction relative to the vent door opening and the spring constant of said at least one spring.

2. The automatic vent damper according to claim 1, wherein said housing has a closed upper side and a lower side, the at least one vent door opening consisting of a single vent door opening defined in the lower side, the housing forming an asymmetrical off-ridge configuration adapted for attachment to a roof offset from a ridge of the roof.

3. The automatic vent damper according to claim 1, wherein said housing has opposed first and second vent door openings defined therein, the housing forming a laterally symmetrical ridge top configuration adapted for symmetric placement over a ridge of a roof.

4. The automatic vent damper according to claim 1, further including:

a first frame member and a second frame member opposite said first frame member disposed at opposite ends of the vent door opening, each said frame member having at least a vent door pivot pin and a vent door yoke roller extending therefrom, and at least one vent door yoke spring attachment point defined therein;

a vent door yoke having an elongated roller slot defined therein and a distal vent door attachment arm extending therefrom, the vent door yoke roller being slidingly disposed within the roller slot of said vent door yoke;

at least one tension spring disposed between the door yoke spring attachment point of each said frame member and said vent door yoke, biasing said vent door attachment arm to an outwardly extended position relative to the vent door opening of said housing; and a yoke attachment lug disposed upon said vent door, pivotally connecting said vent door to said vent door attachment arm of said yoke.

5. The automatic vent damper according to claim 1, wherein said vent door attachment comprises a first block and a second block, each of the blocks having a pivot pin channel disposed therein, the blocks being assembled in mirror image relationship to one another, the channels being aligned to define a closed pivot pin passage.

6. The automatic vent damper according to claim 1, further including:

a first frame member and a second frame member opposite said first frame member disposed at opposite ends of the vent door opening, each said frame member having a vent door pivot pin and a vent door spring attachment pin extending therefrom;

a door pivot pin extending from each said frame member, said vent door attachment being pivotally mounted on the pivot pin; and a helical vent door torsion spring disposed about at least one said door pivot pin, said spring having a first end affixed to the vent door spring attachment pin of at least one said frame member and a second end disposed against said at least one vent door, biasing said at least one vent door to an open position.

7. An off-ridge vent having an aerodynamically actuated closure for automatically opening and closing the closure, comprising:

an asymmetrical housing having a closed upper side and a lower side having a single vent door opening defined therein, the opening having at least an upper edge and a lower edge opposite the upper edge;

at least one aerodynamic vent door having at least an upper edge and a lower edge opposite the upper edge, the door being pivotally disposed over the vent door opening, wherein:

said at least one aerodynamic vent door has a downwardly facing positive camber when in an open position, whereby wind flow entering the at least one vent door generates an aerodynamic force drawing said at least one vent door automatically closed; and said at least one aerodynamic vent door further has an outwardly facing concave face when in a closed position, whereby wind flow contacting the concave face holds said at least one vent door automatically in a closed position, the outwardly facing concave face having a concave contour extending over the entire outwardly facing concave face;

a vent door attachment disposed at the upper edge of the vent door opening, pivotally securing the upper edge of said vent door to said housing; and at least one spring connected between said at least one vent door and said housing, automatically biasing said at least one vent door open in wind conditions less than a predetermined velocity and direction relative to the vent door opening and the spring constant of said at least one spring and automatically allowing said at least one vent door to blow to a closed position when the wind reaches a predetermined velocity and direction relative to the vent door opening and the spring constant of said at least one spring.

8. The off-ridge vent according to claim 7, further including:

a first frame member and a second frame member opposite said first frame member disposed at opposite ends of the vent door opening, each said frame member having at least a vent door pivot pin and a vent door yoke roller extending therefrom, and at least one vent door yoke spring attachment point defined therein;

a vent door yoke having an elongated roller slot defined therein and a distal vent door attachment arm extending therefrom, the vent door yoke roller being slidingly disposed within the roller slot of said vent door yoke;

at least one tension spring disposed between the door yoke spring attachment point of each said frame member and said vent door yoke, biasing said vent door attachment arm to an outwardly extended position relative to the vent door opening of said housing; and a yoke attachment lug disposed upon said vent door, pivotally connecting said vent door to said vent door attachment arm of said yoke.

9. The off-ridge vent according to claim 7, wherein said vent door attachment comprises a first block and a second block, each of the blocks having a pivot pin channel disposed therein, the blocks being assembled in mirror image relationship to one another, the channels being aligned to define a closed pivot pin passage.

10. The off-ridge vent according to claim 7, further including:

a first frame member and a second frame member opposite said first frame member disposed at opposite ends of the vent door opening, each said frame member having a vent door pivot pin and a vent door spring attachment pin extending therefrom;

a door pivot pin extending from each said frame member, said vent door attachment being pivotally mounted on the pivot pin; and a helical vent door torsion spring disposed about at least one said door pivot pin, said spring having a first end affixed to the vent door spring attachment pin of at least one said frame member and a second end disposed against said at least one vent door, biasing said at least one vent door to an open position.

11. An automatic vent damper, comprising:

a housing having a vent door opening defined therein, the opening having at least an upper edge and a lower edge opposite the upper edge;

a first frame member and a second frame member opposite said first frame member disposed at opposite ends of the vent door opening, each said frame member having at least a vent door pivot pin and a vent door yoke roller extending therefrom, and at least one vent door yoke spring attachment point defined therein;

a vent door yoke having an elongated roller slot defined therein and a distal vent door attachment arm extending therefrom, the vent door yoke roller being slidingly disposed within the roller slot of said vent door yoke;

at least one tension spring disposed between the door yoke spring attachment point of each said frame member and said vent door yoke, biasing said vent door attachment arm to an outwardly extended position relative to the vent door opening of said housing;

at least one aerodynamic vent door having at least an upper edge and a lower edge opposite the upper edge, the door being pivotally disposed over the at least one vent door opening, said at least one vent door having a downwardly facing positive camber when in an open position, whereby wind flow entering the at least one vent door generates an aerodynamic force drawing said at least one vent door closed, said at least one vent door further having an outwardly facing concave face when in a closed position, whereby wind flow contacting the concave face holds said at least one vent door in a closed position, the outwardly facing concave face having a concave contour extending over the entire outwardly facing concave face; and a yoke attachment lug disposed upon said vent door, pivotally connecting said vent door to said vent door attachment arm of said yoke.

12. The automatic vent damper according to claim 11, wherein said housing has a closed upper side and a lower side, the at least one vent door opening consisting of a single vent door opening defined in the lower side, the housing forming an asymmetrical off-ridge configuration adapted for attachment to a roof offset from a ridge of the roof.

13. The automatic vent damper according to claim 11, wherein said housing has opposed first and second vent door openings defined therein, the housing forming a laterally symmetrical ridge top configuration adapted for symmetric placement over a ridge of a roof.

14. The automatic vent damper according to claim 11, wherein said vent door attachment comprises a first block and a second block, each of the blocks having a pivot pin channel disposed therein, the blocks being assembled in mirror image relationship to one another, the channels being aligned to define a closed pivot pin passage.

* * * * *